US005454497A

United States Patent [19]

Kettelson

[11] Patent Number: 5,454,497

[45] Date of Patent: Oct. 3, 1995

[54] HANGING BEVERAGE CONTAINER CARRIER

[75] Inventor: Russell W. Kettelson, Waterford, Mich.

[73] Assignee: Roger Kidder, Madison Heights, Mich.

[21] Appl. No.: 276,628

[22] Filed: Jul. 18, 1994

[51] Int. Cl.[6] ..... A45F 3/00; A45F 3/16

[52] U.S. Cl. ..... 224/148; 224/202; 224/250; 211/74; 248/312; 62/457.4

[58] Field of Search ..... 224/148, 202, 224/250; 211/71, 74; 229/1.5 H; 248/102, 103, 104, 312; 62/457.4; D3/229; D7/619, 620

[56] References Cited

U.S. PATENT DOCUMENTS

| | | | |
|---|---|---|---|
| D. 59,662 | 11/1921 | Lauzon . | |
| D. 208,318 | 8/1967 | Kirsch | 224/148 |
| D. 227,043 | 5/1973 | Van Den Berg | 224/148 |
| D. 259,063 | 4/1981 | Manikas | D3/229 |
| D. 279,624 | 7/1985 | Rich | D3/229 |
| D. 333,071 | 2/1993 | Lim | D7/620 |
| D. 340,583 | 10/1993 | Kahn | D3/106 |
| D. 343,293 | 1/1994 | Montgomery | D7/619 |
| D. 347,766 | 6/1994 | Kalat | D3/229 |
| D. 349,190 | 8/1994 | Wasserman | D7/619 |
| 1,208,728 | 12/1916 | Bartlett et al. . | |
| 2,711,872 | 6/1955 | Lampke | 248/103 |
| 3,144,230 | 8/1964 | Brooks | 248/102 |
| 3,820,695 | 6/1974 | Pecjak | 224/148 |
| 3,918,920 | 11/1975 | Barber | 211/74 |
| 4,248,366 | 2/1981 | Christiansen | 224/148 |
| 4,399,668 | 8/1983 | Williamson | 229/1.5 H |
| 4,754,903 | 7/1988 | Dennis | 224/148 |
| 4,798,863 | 1/1989 | Rimmer | 62/457.4 |
| 4,993,611 | 2/1991 | Longo | 224/148 |

*Primary Examiner*—Henry J. Recla
*Assistant Examiner*—Charles R. Eloshway
*Attorney, Agent, or Firm*—Charles W. Chandler

[57] ABSTRACT

A carrier for supporting a beverage container includes an extruded tubular body having top and bottom openings. A lace which hangs around the user's neck is mounted on the sidewall of the body so as to span the bottom opening to retain a container in the body. The wall of the carrier has a series of expandable corrugations or a flexible stretchable solid body so that the body can expand to accommodate the diameter and longitudinal shape of the beverage container.

7 Claims, 4 Drawing Sheets

HANGING BEVERAGE CONTAINER CARRIER

BACKGROUND OF THE INVENTION

This invention relates to a beverage container carrier formed of a tubular body (control tube) having an upper opening for receiving the beverage container, and a bottom opening. A string, strap or lace which hangs around the user's neck, is mounted on the body and spans the bottom opening to retain the container in the body. The walls of the carrier are expandable to accommodate different size beverage containers.

Beverage container carriers are commonly used for hanging a container of liquid from the user's neck so he has his arms free to engage in various activities. Examples of such containers may be found in the following U.S. Pat. Nos.: 1,208,728 which was issued Dec. 19, 1916 to F. W. Bartlett, R. B. Grant and E. P. Cooke; Des. 59,662 which was issued Nov. 15, 1921 to Hector Lauzon; 3,144,230 which was issued Aug. 11, 1964 to Durward L. Brooks; 4,248,366 which was issued Feb. 3, 1981 to James S. Christiansen; 4,754,903 which was issued Jul. 5, 1988 to William M. Dennis; Des. 304,890 which was issued Dec. 5, 1989 to Curtis B. Canaan; 4,993,611 which was issued Feb. 19, 1991 to Rocco Longo; Des. 333,071 which was issued Feb. 9, 1993 to Kevin W. Lim; and Des. 340,583 which was issued Oct. 26, 1993 to Kerri J. Kahn. In general, such prior art carriers are composed of several components, and do not readily accommodate containers of different diameters.

SUMMARY OF THE INVENTION

The broad purpose of the present invention is to provide a beverage contained carrier comprising two basic components, that is, a lace or strap that hangs around the user's neck, and a tubular body having top and bottom openings. The lace is connected to the body and spans the bottom body opening to retain the beverage contained in the body. The carrier wall has a series of circumferentially- spaced expandable corrugations which permit the body to expand according to the diameter and longitudinal configuration of the beverage container.

The body is preferably formed of an extrusion, however, it can take other forms, such as a corrugated sheet folded to form a cylindrical body.

The two-piece construction preferably includes a string or lace about 48 inches long, and a control tube or body about 4 inches long and 2½ inches in diameter. The lace performs four tasks, that is, it supports the beverage container beneath the body; it confines the body by passing along the length of the body and is restrained either by a tight fit or a pair of knots; it serves as an adjustable neck loop, and it offers a bottom support for an auxiliary display hook.

The control tube or body performs three tasks: it conforms to the basic shape and size of the beverage container, whether it has either a cylindrical or a somewhat conical shape, to accommodate cans, bottles and glasses; it acts as a barrier between the user's hand and/or body, for either a hot or a cold beverage; and it offers single or multiple advertising panels for logos, trademarks, or other events.

The carrier requires only a single lace that is already available in many materials and colors, such as boot laces. The body, is a simple (cut to length) section of a uniquely-shaped, resilient plastic extrusion. The preferred container has a low cost, conforms to various sized shapes, can be easily assembled and adjusted, and easily manufactured. It can be used in a variety of environments, such as stadium events, sporting events, concerts, and the like.

Another embodiment of the invention comprises a resilient, rubber-like tube. The opposite side walls of the tube have a longitudinal opening for receiving the lace. The side walls are split to form a pair of lips. The lace is inserted between the lips to a supporting position in the tube wall.

Still another embodiment of the invention comprises a resilient, expandable tube having a pair of longitudinal openings on opposite sides if the tube wall for receiving the lace. In all embodiments, the lace is passed down one side of the tubular wall, spans the bottom opening and then is inserted up through the opposite side of the side wall.

Still further objects and advantages of the invention will become readily apparent to those skilled in the art to which the invention pertaining upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1:
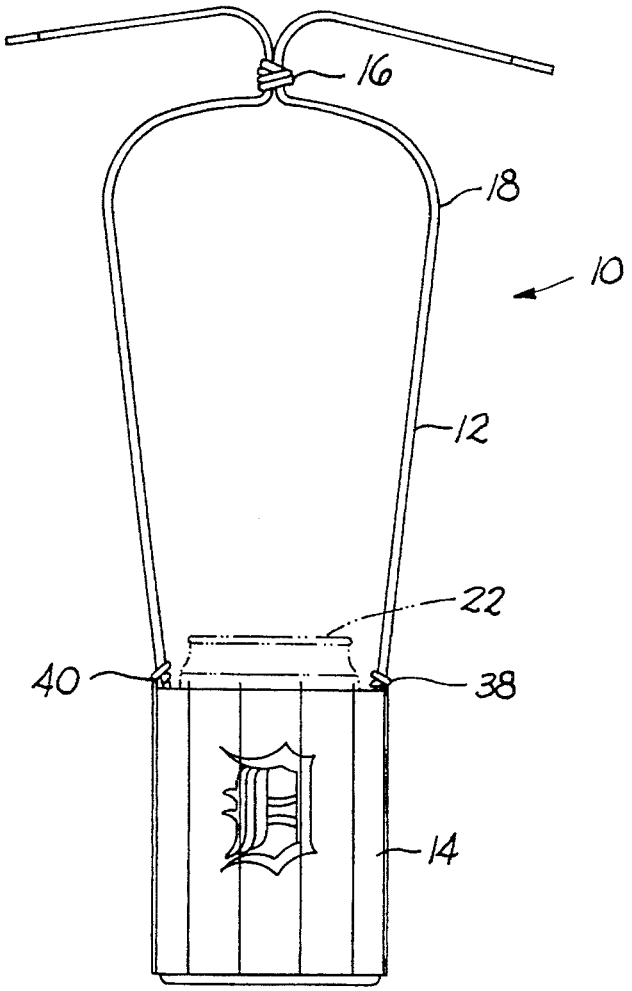
FIG. 1 is an elevational view of a beverage container carrier illustrating the preferred embodiment of the invention.

Referring to the drawings, a preferred carrier 10 comprises a lace 12 and a control tube 14. The lace may be any commercially-available lace material, and is about 48 inches long. It may also comprise a suitable string or strap. The upper ends of the laces are joined together by a knot 16 to form a loop 18 which accommodates the particular configuration of the user. The loop is hung around the user's neck.

Figure 2:
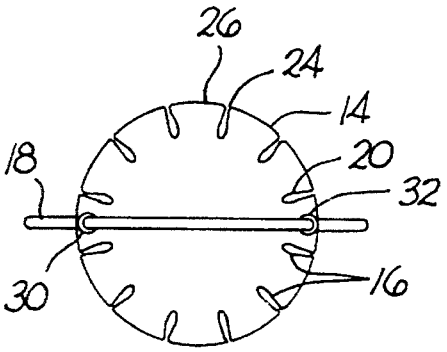
FIG. 2 is a bottom view of the container of FIG. 1.

Control tube 14, as illustrated in FIGS. 1 and 2, comprises a plastic extrusion having a generally cylindrical configuration. The inside diameter is about 2½ inches and the height is about 4 inches.

The control tube has, for illustrative purposes, twelve internal expandable corrugations 20. The corrugations are equi-distantly located about the circumference of the control tube. Each corrugation extends the full height of the control tube. The corrugations are formed with a curved loop-type cross section so that when the user inserts a container, illustrated in phantom at 22, having a diameter slightly greater than the internal diameter of the control tube, the container pushes the corrugations outwardly. As the corrugations are pushed outwardly, opening 24 of a typical corrugation opens so that the cylindrical wall sections 26 between each pair of the corrugations 20 expands outwardly to accommodate the diameter of the beverage container.

Figure 5:
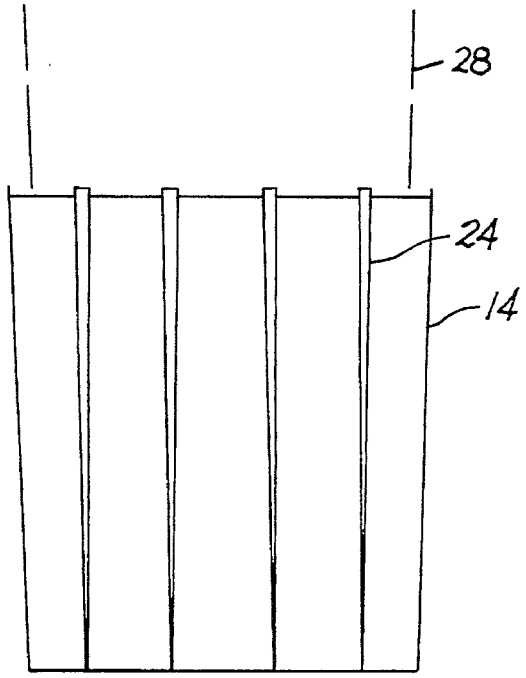
FIG. 5 is a view showing the manner in which the body expands to accommodate a container having a slightly conical configuration.

Referring to FIG. 5, the corrugations are formed in such a manner that if a container 28, such as an ice cream cup having a slightly frusto-conical configuration, is inserted in the control tube, the corrugation openings will expand a greater distance toward the top of the tube than at the bottom of the tube. Thus, the control tube assumes a shape that accommodates a non-cylindrical beverage container.

Referring to FIG. 2, the control tube also has a pair of integral internal tubular sections 30 and 32 on opposite sides of the control tube wall. Tubular sections 30 and 32 receive lace 12. Preferably, tubular sections 30 and 32 extend the full height of the control tube, and constitute guideways for lace 12.

Figure 4:
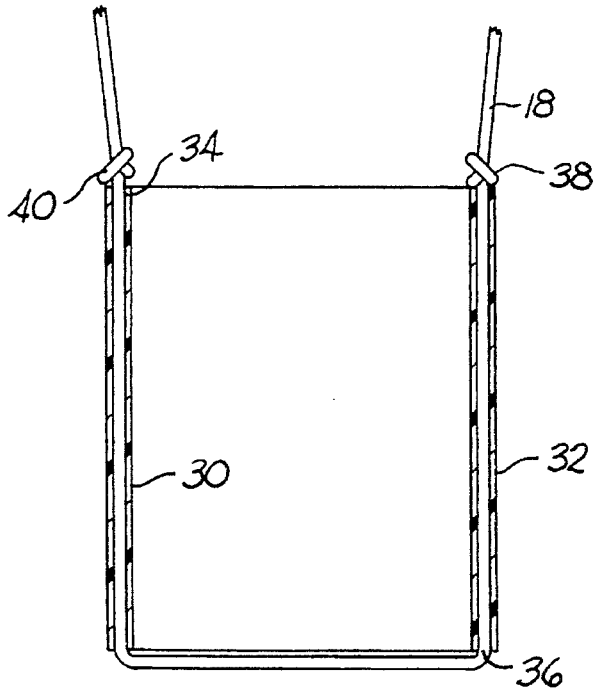
FIG. 4 is a sectional view through the body to show the manner in which the lace is strung through the body sidewall.

As illustrated in FIG. 4, the control tube has a top opening 34 for receiving the beverage container and a bottom opening 36. Lace 12 is inserted down through tubular section 32, across bottom opening 36, and then up through tubular section 30. When the two outer lace ends are approximately of equal length, the lace is tied with knots 38 and 40, adjacent opening 34 to lock the lace in position lengthwise on the control tube. The user then determines the location of knot 16 and connects the two outer ends of the lace together.

The lace can be locked by other means at the upper end of the control tube, for example, by inserting of a fastener such as a clip (not shown) instead of the knot.

Figure 3:
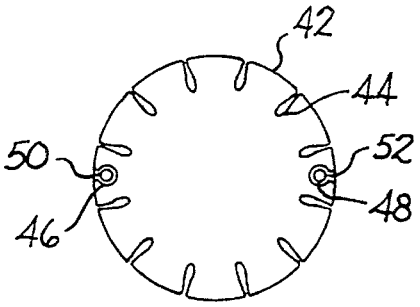
FIG. 3 illustrates an alternative cross-section of the extruded body.

FIG. 3 show s an alternative control tube 42 cross-section which is similar ,to control tube 14, that is, it includes ten internal corrugations 44 which are expandable to accommodate the diameter of the beverage container. In addition, tube 42 includes two expandable internal corrugations or channels 46 and 48 which replace tubular sections **3*b* and 32 of the embodiment of FIG. 2 Corrugations 46 (channels) and 48 have a pair of narrow slot-like openings 50 and 52, respectively. The lace, instead of being strung through tubular sections 30 and 32, is snapped into tubular sections 46 and 48 by pressing the lace adjacent narrow openings 50 and 52 until the slot-like openings expand to receive the lace. For this reason, the wall of corrugations 46 and 48 is thicker than the wall of corrugations 44 because corrugations 46 and 48 are not intended to expand with the insertion of a beverage container, but only when the lace is firmly pressed against the outside wall of the control tube for assembly. Corrugations (channels) 46 and 48 constitute guideways for lace 12, whereby the lace is firmly attached to tubular body 42**.

Figure 6:
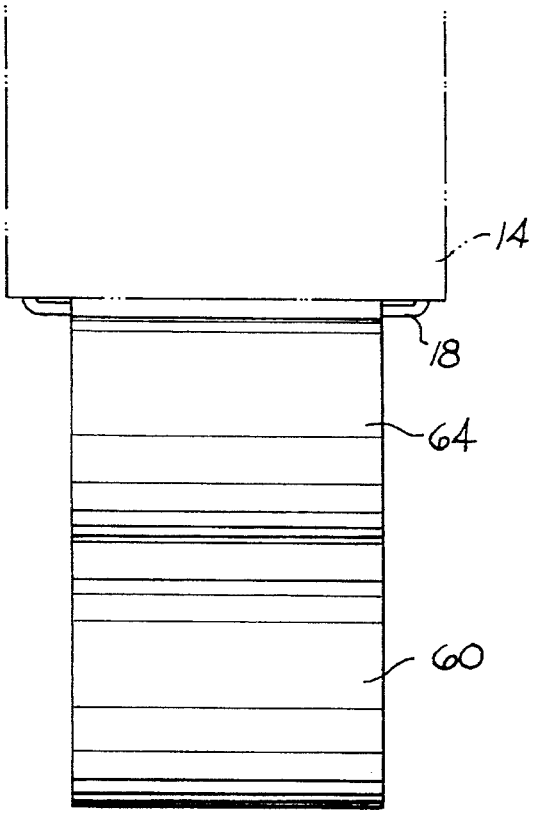
FIG. 6 shows an auxiliary hanger hooked to the lace at the bottom of the carrier.
Figure 7:
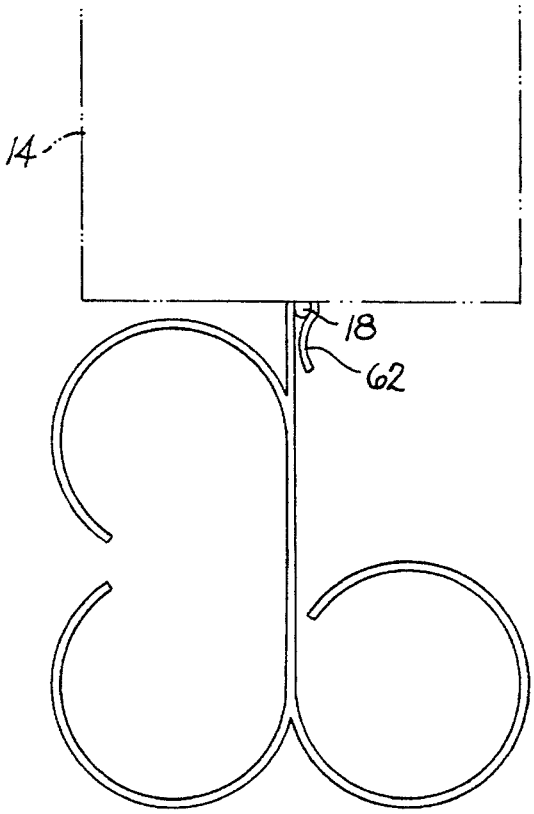
FIG. 7 is a view as seen from the right side of FIG. 6.

FIGS. 6 and 7 illustrate an auxiliary hanger device 60 having a hook-shaped retainer 62 that receives that portion of the lace that spans the bottom opening of the control tube. The display device has a relatively large display area 64 on which the user can place logos, advertising material, and the like, which hang from the lace. The height of the display device may be any suitable shape and the width may be up to a width slightly less than the internal diameter of the control tube.

The hanger may be used for carrying a program, an umbrella, a small radio or even a hot dog, if desired.

Figure 8:
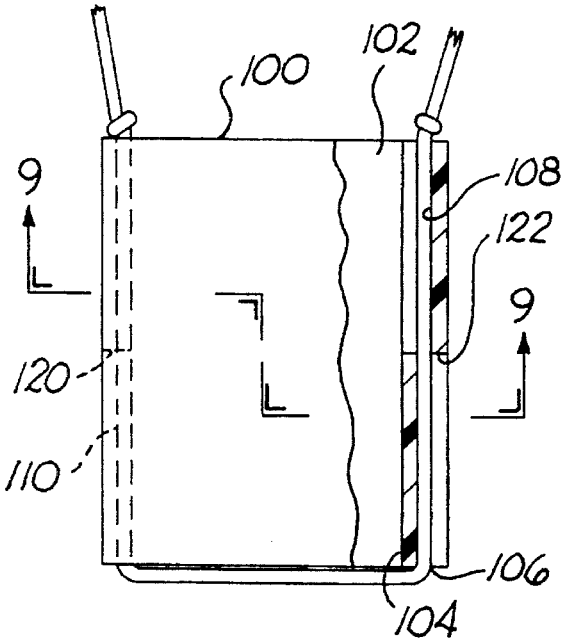
FIG. 8 is a partially fragmentary view through another embodiment of the invention.
Figure 9:
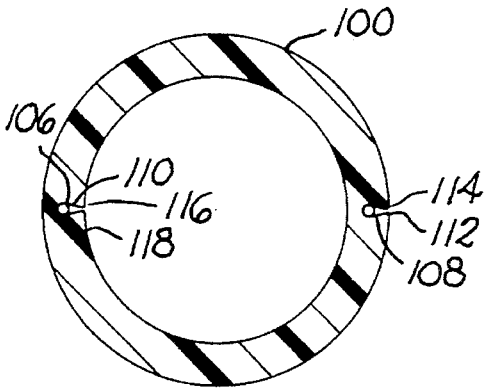
FIG. 9 is a sectional view as seen along line 9—9 of FIG. 8.

FIGS. 8 and 9 illustrate another embodiment of the invention comprising a tubular body 100 having a cross-section with uniform internal and external diameters. Body 100 is formed of a solid, but flexible material, such as a foam rubber. Body 100 has a top opening 102 and a bottom opening 104. Lace 106 is inserted through a vertical slot 108 on one side of the body across the bottom opening 104 and up a second slot 110 on the opposite side of the body. Slot 108 extends from the top of the body down half-way toward the bottom, The bottom half slot is formed by a pair of lips 112 and 114 Which open when the lace is pressed against the two lips to receive the lace into slot 108. Slot 110 on the opposite side of the tube has a pair of outwardly opening lips for receiving the lace.

The top half of slots 108 and 110 have a pair of resilient lips 118 that face the inside of the tubular body and also open to receive the lace when it is pressed against the internal side wall of the tubular body.

The lace is inserted in the two slots by pushing the tips between the upper end of the lower lips and the bottom end of the upper lips. You can then pull the lace from the inside of the tube upwardly so that the lace is passed through the lips at the lower end of the slots. Then by pressing the lace against the inside surface of the inwardly facing lips, the lace is inserted into the upper ends of the two slots. This process is quick. Further the tubular body also has the ability to expand along its height to accommodate an irregularly shaped container.

Figure 10:
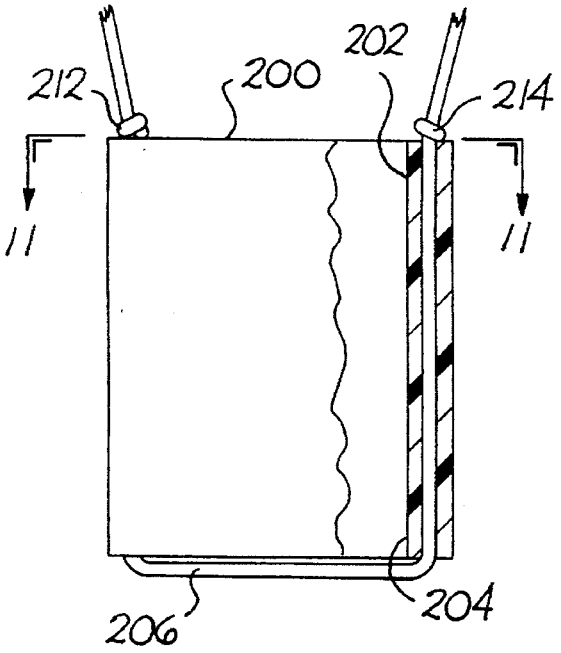
FIG. 10 is a partially fragmentary sectional view of still another embodiment of the invention.
Figure 11:
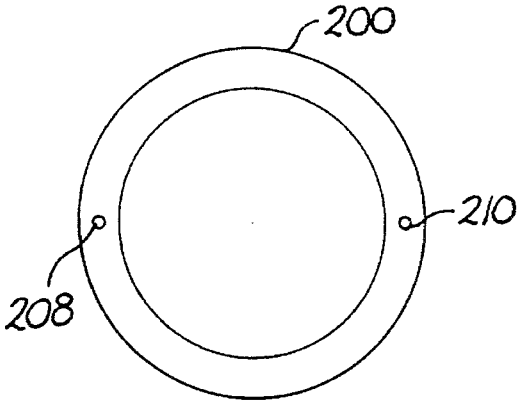
FIG. 11 is a view as seen along line 11—11 of FIG. 10.

FIGS. 10 and 11 show another carrier 200 having the same height, internal diameter and external diameter of the embodiment of FIG. 8 including a top opening 202 and a bottom opening 204. The body is formed of a solid but resilient material such as foam rubber. The body has an unstressed internal diameter and external diameter that is uniform along its length. However, the carrier can expand according to the shape of the container being inserted in the carrier.

A lace 206 is inserted through a pair of longitudinal openings 208 and 210 on opposite sides of the body and then locked in place with knots 212 and 214.

The term "lace" as used herein includes any suitable string or strap, that is, an elongated, flexible connecting element.

Having described my invention, I claim:

1. A carrier for beverage containers, comprising:

a hollow upright cylindrical tubular body having an open upper end and an open bottom end;

said tubular body comprising an endless circumferential wall having a plurality of vertically-extending corrugations spaced circumferentially along an internal surface thereof;

said endless circumferential wall having a constant cross-section from said open upper end to said open bottom end, whereby the tubular body is resiliently expandable by flexure of the internal corrugations, such that beverage containers of varying shapes and sizes can be retained in the tubular body;

first and second lace guideways integrally formed with said circumferential wall at diametrically spaced points thereacross; each guideway extending from the bottom end to the upper end of the tubular body; and a flexible lace for suspending said tubular body from the neck of the user; said flexible lace comprising a loop portion (18) extendable around the user's neck, two attachment portions extending within said guideways, and a container-retainer portion extending across said open bottom end for preventing a beverage container from passing through the open bottom end of the tubular body.

2. A carrier as defined in claim 1, wherein each guideway comprises a tubular section integral with said endless circumferential wall; each tubular section forming a vertical hole adapted to contain a portion of said lace.

3. A carrier as defined in claim 1, wherein each guideway comprises an expandable channel having a relatively narrow entrance slot (50 or 52), whereby the lace can be manually pressed through each respective slot for capture within the respective channel.

4. A carrier as defined in claim 1, wherein said lace is a heavy string.

5. A carrier is defined in claim 1, wherein said tubular body is a plastic extrusion.

6. A carrier as defined in claim 1, wherein said corrugations are equidistantly spaced around the endless circumferential wall.

7. A carrier as defined in claim 1, wherein each corrugation has a curved loop-type section.

* * * * *